US012404695B1

(12) United States Patent
Hillis

(10) Patent No.: US 12,404,695 B1
(45) Date of Patent: Sep. 2, 2025

(54) PORTABLE PRIVACY SCREEN

(71) Applicant: Logan Hillis, Houston, TX (US)

(72) Inventor: Logan Hillis, Houston, TX (US)

( * ) Notice: Subject to any disclaimer, the term of this patent is extended or adjusted under 35 U.S.C. 154(b) by 240 days.

(21) Appl. No.: 18/208,956

(22) Filed: Jun. 13, 2023

(51) Int. Cl.
*E01F 13/00* (2006.01)
*E04H 15/48* (2006.01)
*E04H 15/32* (2006.01)

(52) U.S. Cl.
CPC ..... *E04H 15/48* (2013.01); *E01F 13/00* (2013.01); *E04H 2015/328* (2013.01)

(58) Field of Classification Search
CPC . E04H 15/48; E04H 2015/328; E04H 15/003; E04H 15/005; E01F 15/06; E01F 15/065; E01F 15/10; E01F 7/00; E01F 7/02; E01F 7/025; E01F 7/04; E01F 7/045; E01F 7/06
See application file for complete search history.

(56) References Cited

U.S. PATENT DOCUMENTS 2,652,845 A * 9/1953 O'Neill ..... E04H 15/003 135/90
4,124,196 A 11/1978 Hipskind
4,134,439 A 1/1979 Scott
4,186,912 A 2/1980 Byrd
4,529,173 A * 7/1985 Kramer ..... E01F 7/02 256/12.5
4,533,122 A 8/1985 Bannister
5,269,623 A 12/1993 Hanson
5,371,982 A * 12/1994 Douglas ..... E01F 7/00 52/64
5,373,863 A * 12/1994 Prizio ..... E04H 15/001 135/117
5,379,786 A * 1/1995 Lynam ..... E04H 15/003 160/135
5,553,648 A * 9/1996 Goharjou ..... E01F 7/00 160/237
5,595,230 A 1/1997 Guerra
5,732,935 A * 3/1998 Codario, Jr. ..... E01F 7/025 256/31
6,036,249 A 3/2000 Kuntz
6,360,761 B1 * 3/2002 Zheng ..... A63B 9/00 220/9.3
D486,529 S 2/2004 Valenzuela
6,733,204 B1 5/2004 Paniccia
6,969,185 B1 * 11/2005 Adair ..... G09F 7/00 362/486
7,252,106 B2 * 8/2007 Conforti ..... B60J 1/2091 135/117

(Continued)

*Primary Examiner* — Johnnie A. Shablack
(74) *Attorney, Agent, or Firm* — Kyle A. Fletcher, Esq.

(57) ABSTRACT

The portable privacy screen includes one or more barrier sections, a plurality of guylines, and a plurality of stakes. The portable privacy screen may be a visual barrier that may be adapted to be erected at an accident scene to provide privacy for an accident victim. An individual barrier section selected from the one or more barrier sections may be collapsed for storage within an emergency vehicle when not in use. The individual barrier section may be secured in place by a plurality of aprons located at the bottom of the individual barrier section, by the plurality of guylines, by the plurality of stakes, or by any combination thereof. The one or more barrier sections may be coupled end-to-end to lengthen the visual barrier.

17 Claims, 9 Drawing Sheets

(56) References Cited

U.S. PATENT DOCUMENTS 7,600,554 B1 10/2009 Wright
8,579,007 B2 * 11/2013 Pottmeyer ..... A01M 31/025 160/351
D707,599 S * 6/2014 Pifer, III ..... D12/183
8,915,258 B1 * 12/2014 Beam ..... E04H 15/001 135/117
8,973,645 B1 * 3/2015 Cannova ..... E01F 7/00 160/351
9,629,470 B2 * 4/2017 Bussell ..... A47C 7/666
10,697,141 B1 6/2020 Hillis
11,199,021 B2 * 12/2021 Cox ..... E04H 15/60
11,486,159 B2 * 11/2022 Shull ..... E04H 15/005
11,758,900 B2 * 9/2023 Sharp ..... A01M 29/30 160/351
2006/0060310 A1 * 3/2006 Haugen ..... G09F 7/18 160/135
2006/0213628 A1 * 9/2006 McLoughlin ..... E01F 7/00 160/351
2008/0054038 A1 * 3/2008 Tonkin ..... A45C 15/00 224/575
2008/0251775 A1 * 10/2008 Haslem ..... E01F 7/025 256/12.5
2010/0288450 A1 * 11/2010 Bruck ..... F16M 11/242 248/176.1
2013/0008617 A1 * 1/2013 Rivera ..... G09F 15/0025 160/127
2013/0048044 A1 * 2/2013 Hope ..... E04H 15/005 135/144
2013/0233365 A1 * 9/2013 Loos ..... E04H 15/005 135/114
2016/0143453 A1 * 5/2016 Shapiro ..... A47D 13/063 256/25
2020/0256083 A1 * 8/2020 Xu ..... E04H 15/34
2022/0395115 A1 * 12/2022 Le ..... A47G 5/00

* cited by examiner

PORTABLE PRIVACY SCREEN

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of emergency equipment and privacy barriers, more specifically, a portable privacy screen.

SUMMARY OF INVENTION

The portable privacy screen comprises one or more barrier sections, a plurality of guylines, and a plurality of stakes. The portable privacy screen may be a visual barrier that may be adapted to be erected at an accident scene to provide privacy for an accident victim. An individual barrier section selected from the one or more barrier sections may be collapsed for storage within an emergency vehicle when not in use. The individual barrier section may be secured in place by a plurality of aprons located at the bottom of the individual barrier section, by the plurality of guylines, by the plurality of stakes, or by any combination thereof. The one or more barrier sections may be coupled end-to-end to lengthen the visual barrier.

An object of the invention is to provide a visual barrier that may erected at an accident scene to provide privacy for an accident victim.

Another object of the invention is to provide one or more barrier sections that may be secured in a vertical orientation by a plurality of aprons, a plurality of guylines, a plurality of stakes, or any combination thereof.

A further object of the invention is to a plurality of buckle clips are both ends of individual barrier sections such that the visual barrier may be extended in length.

Yet another object of the invention is to collapse an individual barrier section and store the individual barrier section in a storage bag when not in use.

These together with additional objects, features and advantages of the portable privacy screen will be readily apparent to those of ordinary skill in the art upon reading the following detailed description of the presently preferred, but nonetheless illustrative, embodiments when taken in conjunction with the accompanying drawings.

In this respect, before explaining the current embodiments of the portable privacy screen in detail, it is to be understood that the portable privacy screen is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the portable privacy screen.

It is therefore important that the claims be regarded as including such equivalent construction insofar as they do not depart from the spirit and scope of the portable privacy screen. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
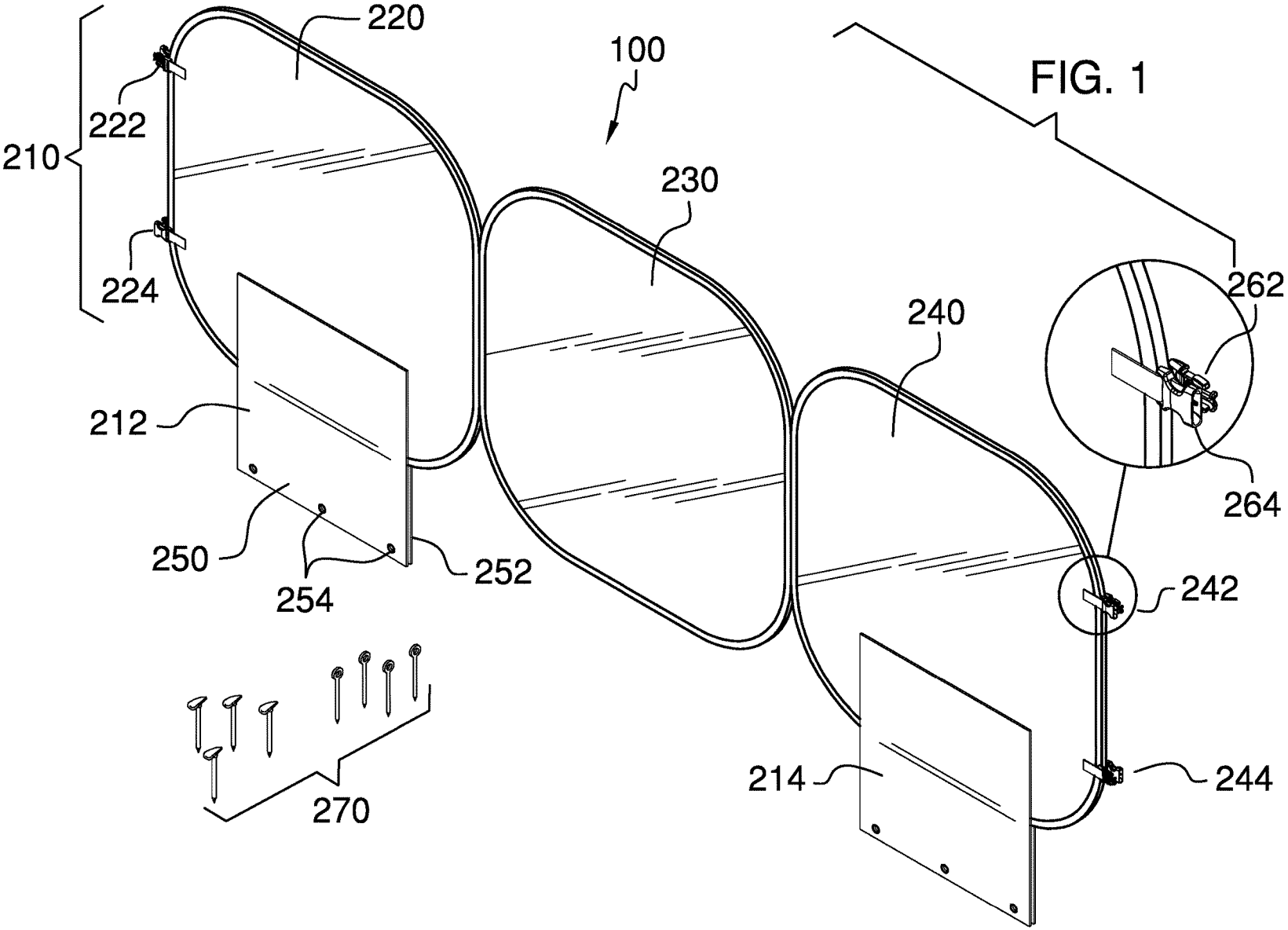
FIG. 1 is an isometric view of an embodiment of the disclosure.
Figure 2:
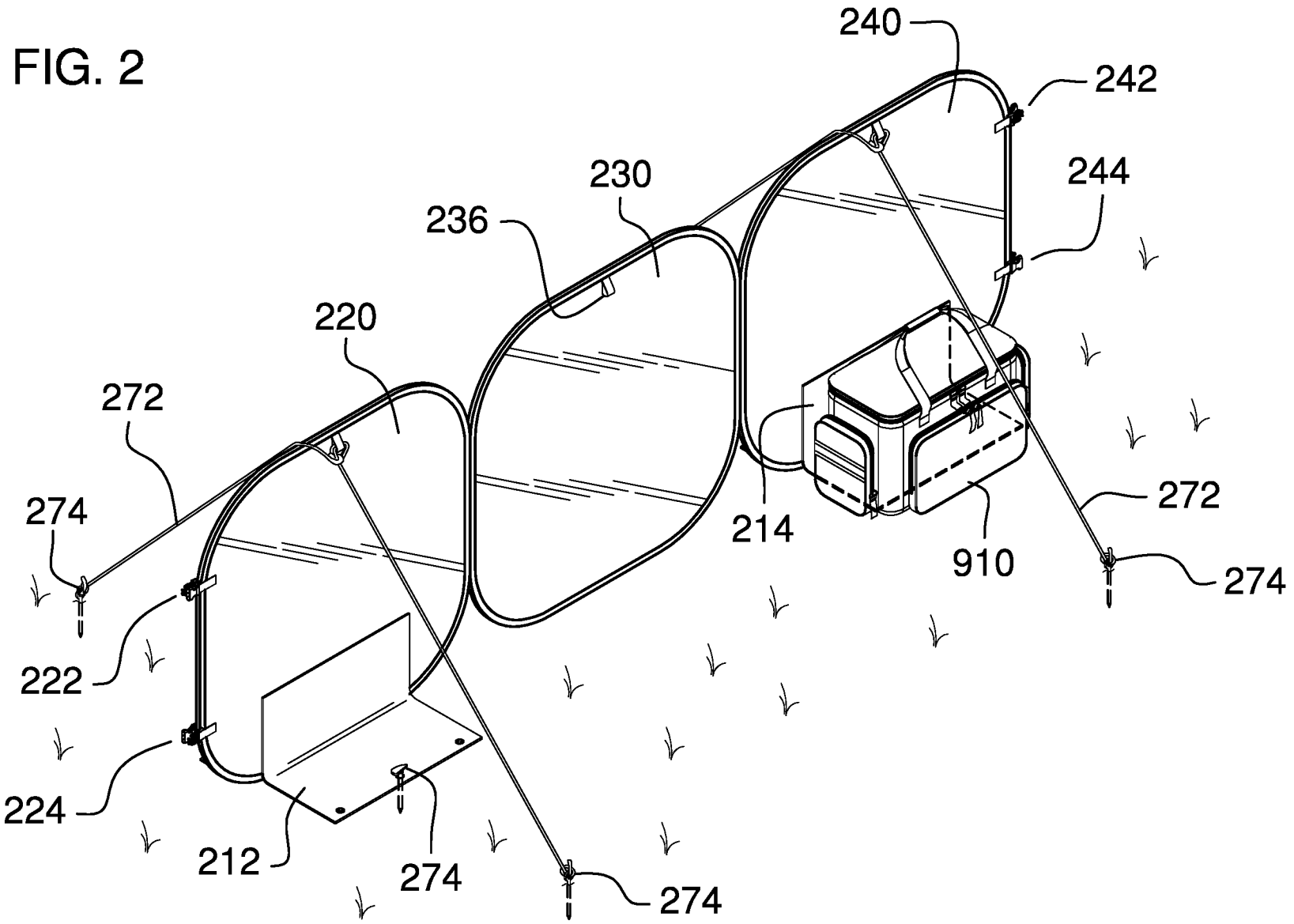
FIG. 2 is am isometric in-use view of an embodiment of the disclosure.
Figure 3:
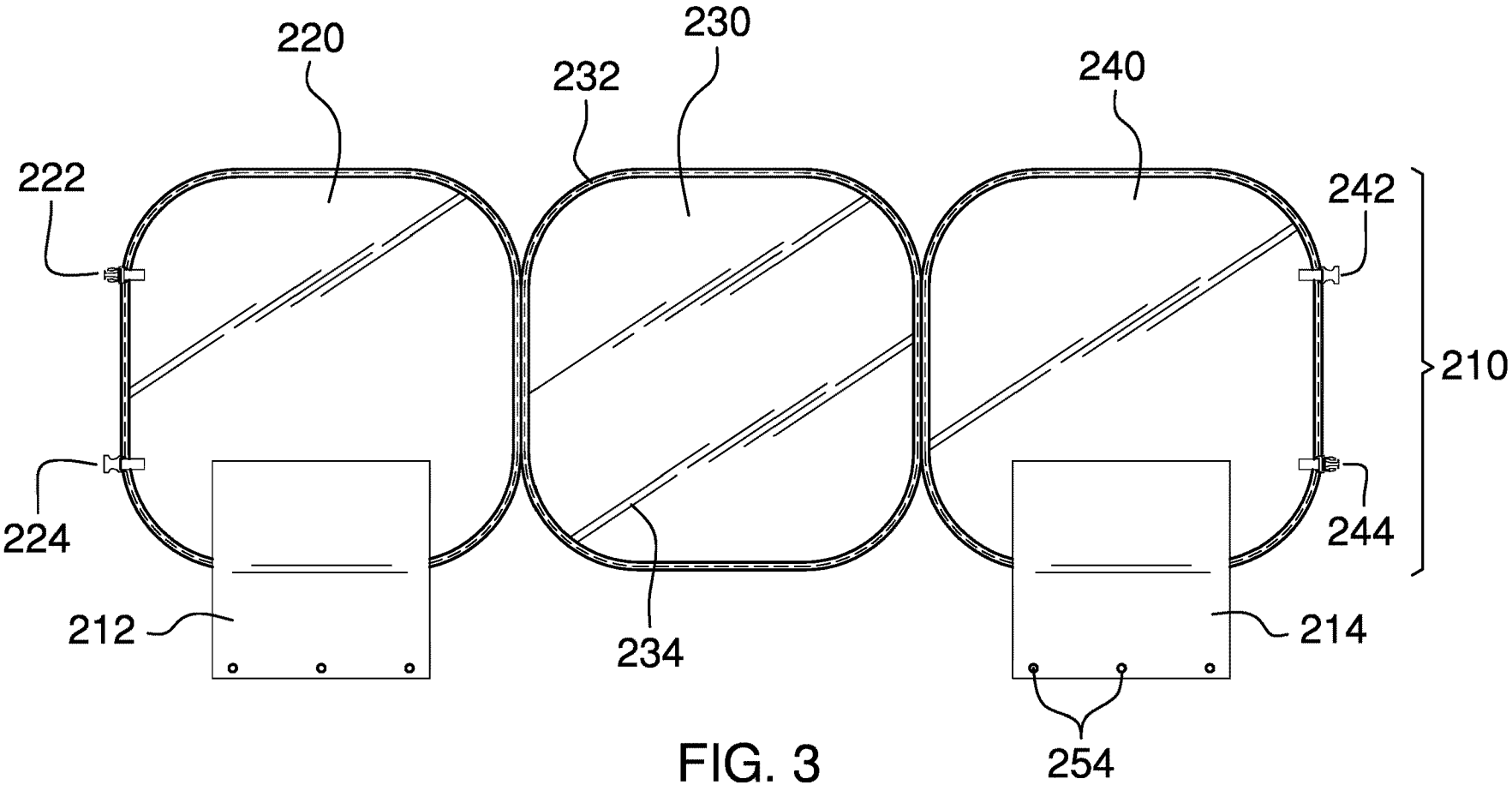
FIG. 3 is a front view of an embodiment of the disclosure.
Figure 4:
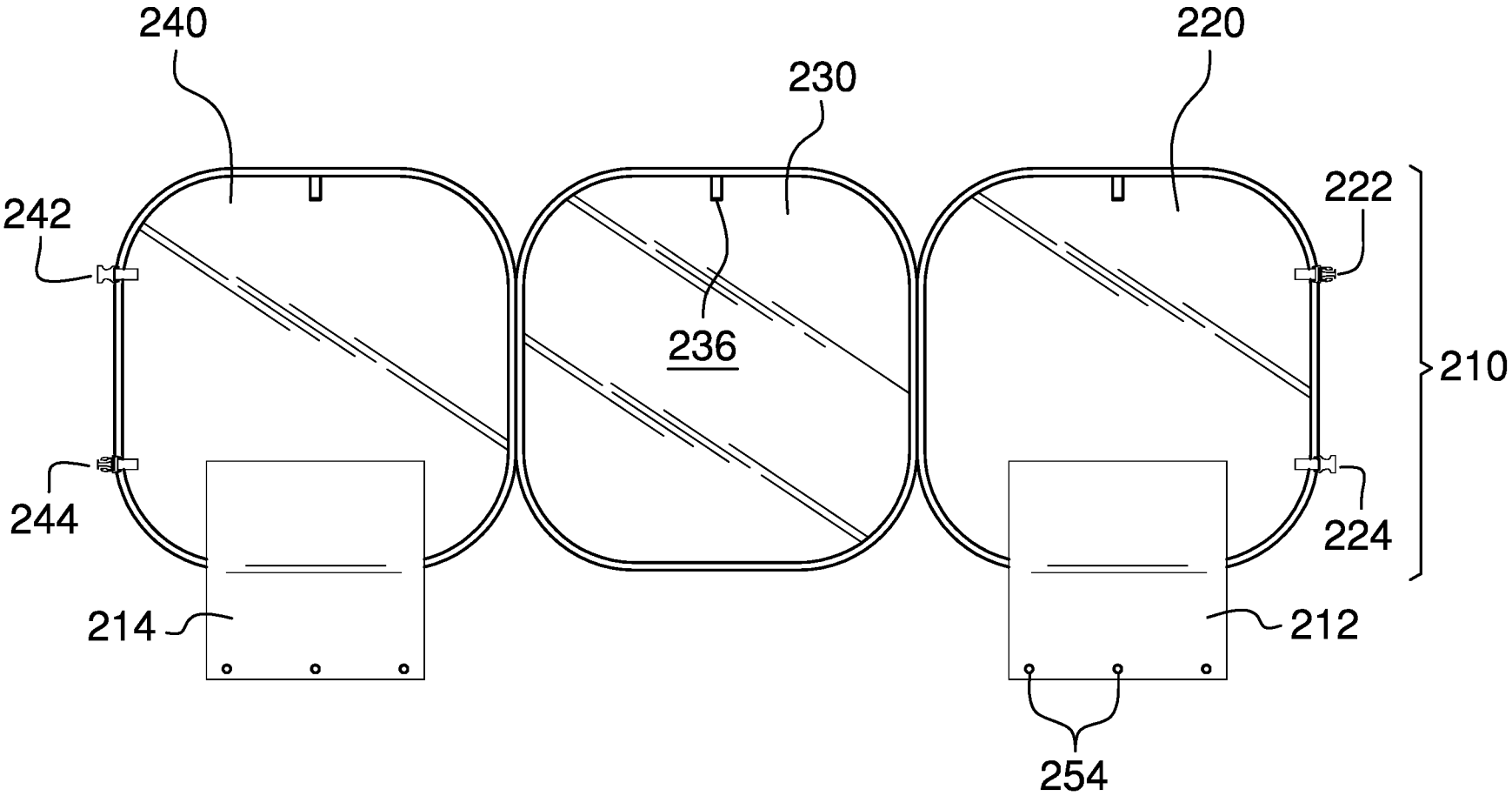
FIG. 4 is a rear view of an embodiment of the disclosure.
Figure 5:
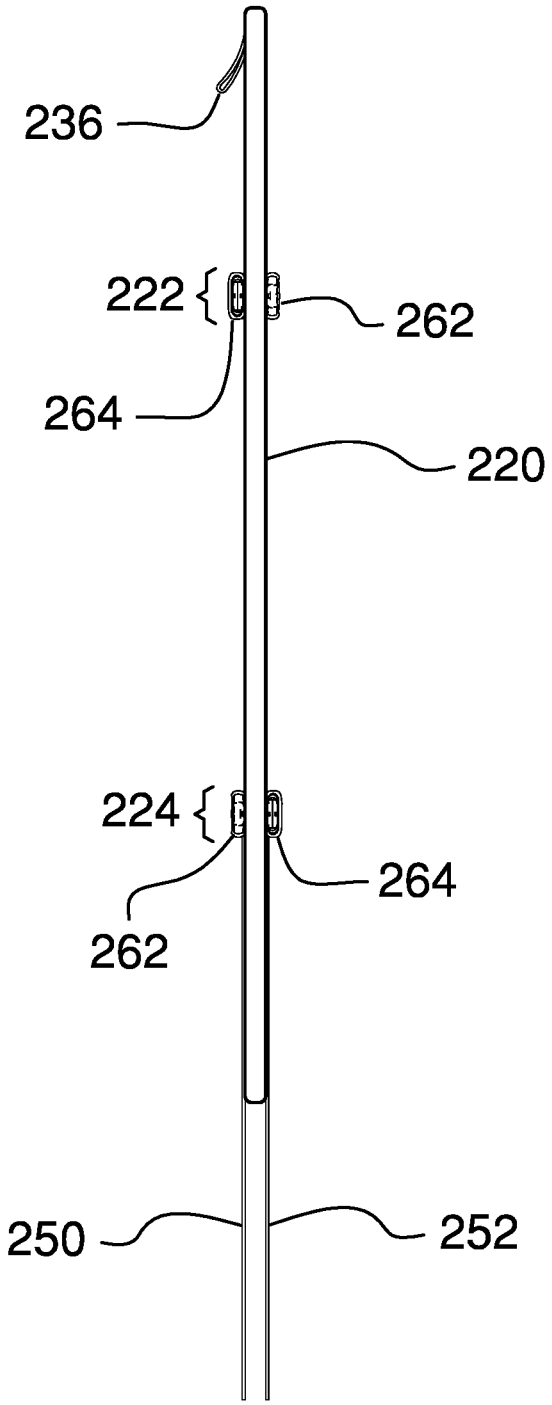
FIG. 5 is a side view of an embodiment of the disclosure.
Figure 6:
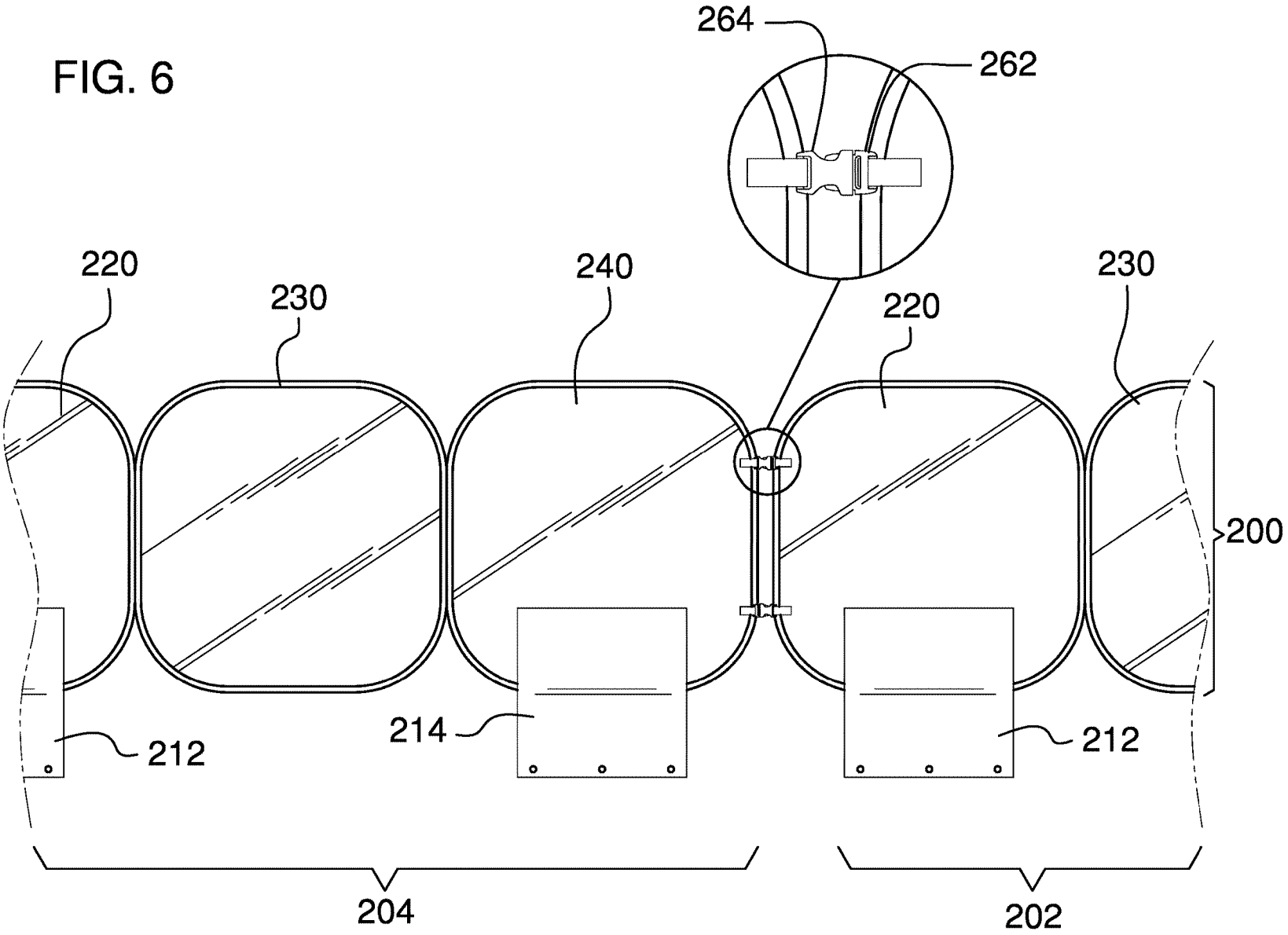
FIG. 6 is a front detail view of an embodiment of the disclosure.
Figure 7:
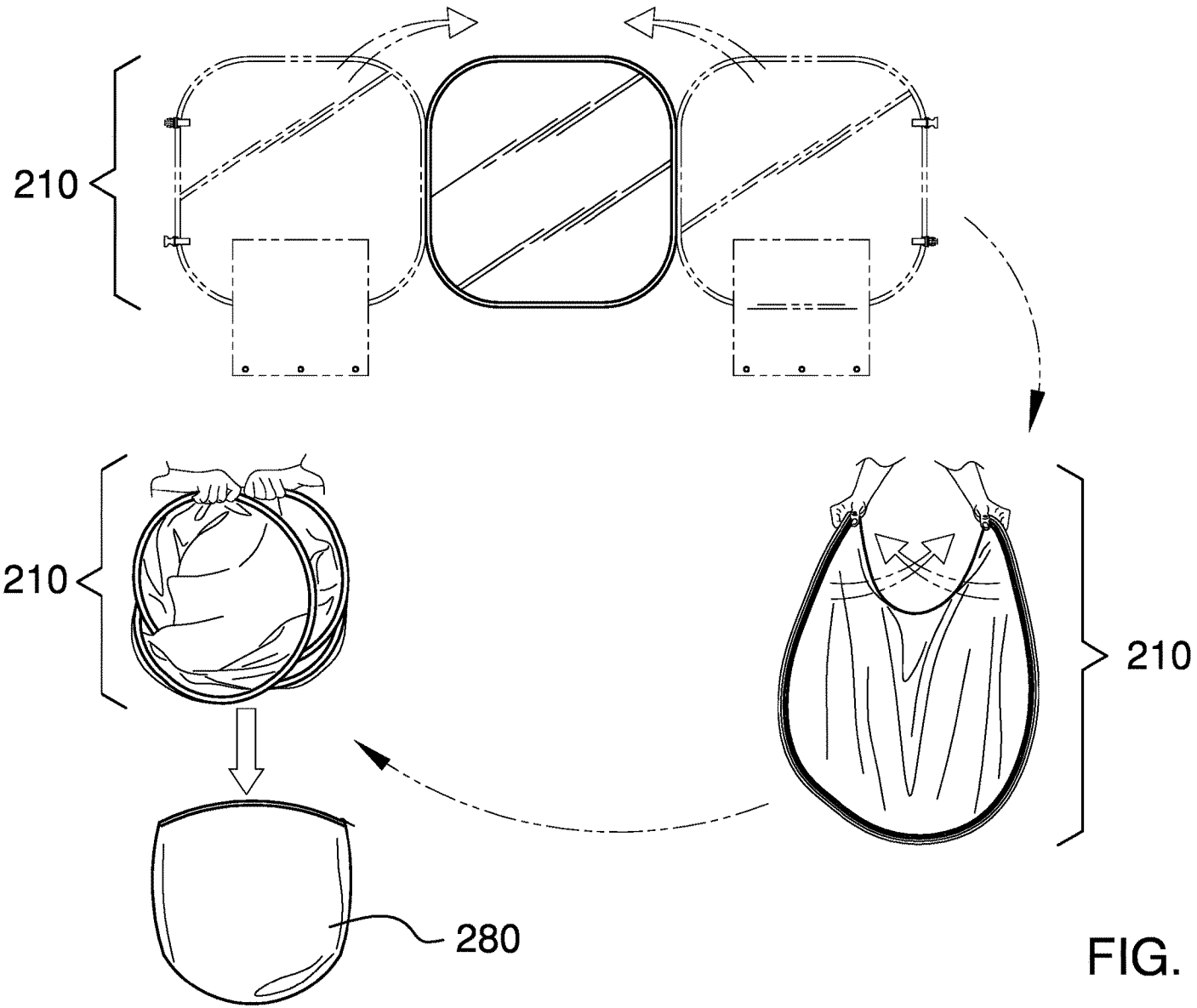
FIG. 7 is a front detail view of an embodiment of the disclosure, illustrating storage of an individual barrier section.
Figure 8:
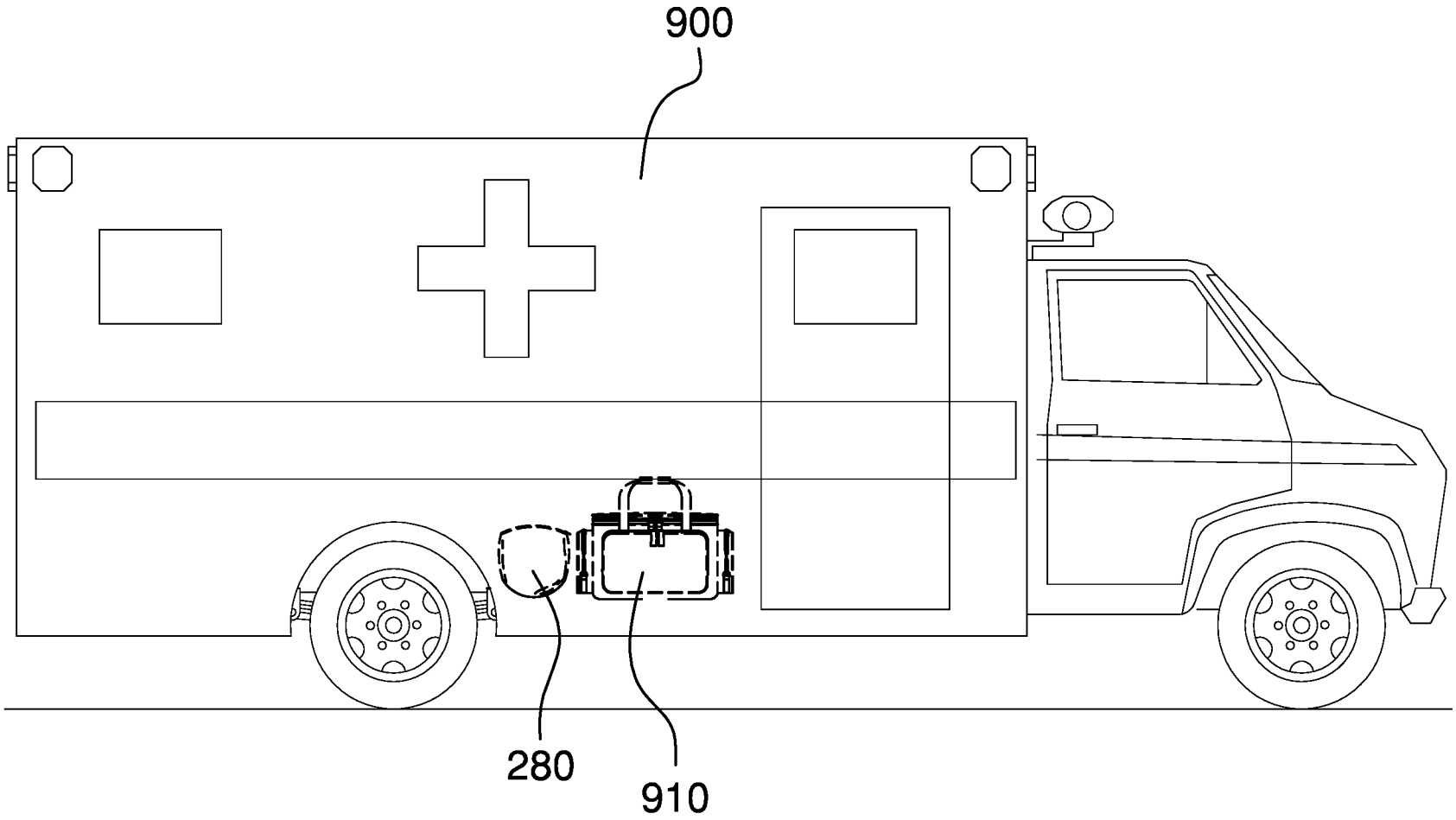
FIG. 8 is an in-use view of an embodiment of the disclosure, illustrating storage of the invention on an emergency vehicle.
Figure 9:
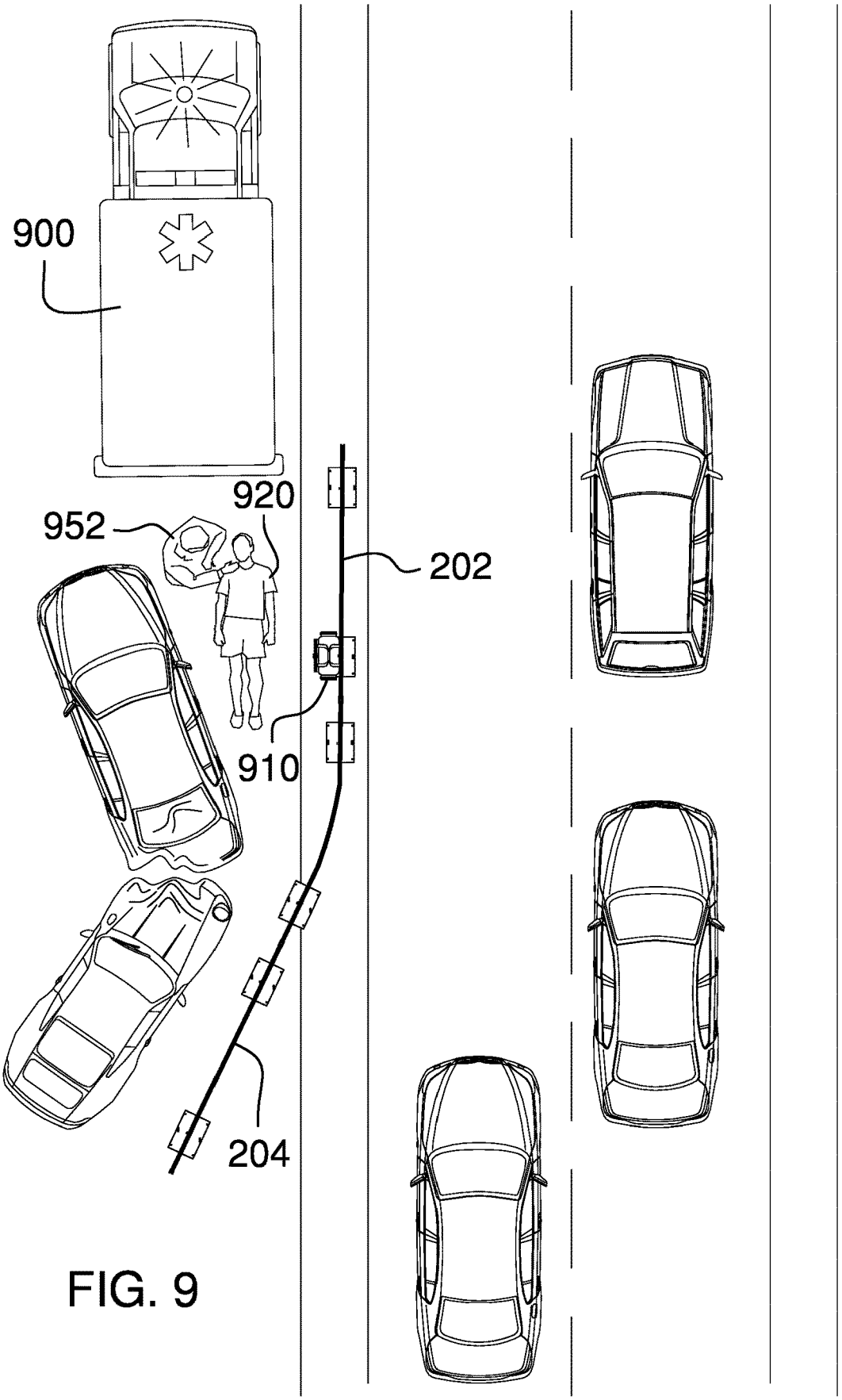
FIG. 9 is an in-use view of an embodiment of the disclosure, illustrating the invention erected at an accident scene.

Detailed reference will now be made to a first potential embodiment of the disclosure, which is illustrated in FIGS. 1 through 9.

The portable privacy screen 100 (hereinafter invention) comprises one or more barrier sections 200, a plurality of guylines, and a plurality of stakes 270. The invention 100 May be a visual barrier that may be adapted to be erected at an accident scene to provide privacy for an accident victim 920. An individual barrier section 210 selected from the one or more barrier sections 200 may be collapsed for storage within an emergency vehicle 900 when not in use. The individual barrier section 210 may be secured in place by a plurality of aprons located at the bottom of the individual barrier section 210, by the plurality of guylines, by the plurality of stakes 270, or by any combination thereof. The one or more barrier sections 200 may be coupled end-to-end to lengthen the visual barrier.

The individual barrier section 210 may comprise a plurality of barrier panels and the plurality of aprons. An individual barrier panel selected from the plurality of barrier panels May be an opaque rectangular panel erected in a vertical orientation to block a sight line. As a non-limiting example, the individual barrier panel may block the sight line between the accident victim 920 and a motorist passing by the accident scene. The plurality of aprons may be flexible extensions coupled to the bottom of one or more of the plurality of barrier panels that may be operable to retain the bottom of the individual barrier panel in place.

In a preferred embodiment, the individual barrier section may comprise three barrier panels and two aprons. The three barrier panels may comprise a left barrier panel 220, a center barrier panel 230, and a right barrier panel 240. The two aprons may comprise a left apron 212 that may be coupled to the bottom of the left barrier panel 220 and a right apron 214 that may be coupled to the bottom of the right barrier panel 240. The plurality of barrier panels may be hingedly coupled such that the left barrier panel 220 and the right barrier panel 240 May fold back by 180 degrees to a position that is adjacent to the center barrier panel 230.

The left barrier panel 220 may comprise an upper pair of left panel buckle clips 222 and a lower pair of left panel buckle clips 224. The right barrier panel 240 may comprise an upper pair of right panel buckle clips 242 and a lower pair of right panel buckle clips 244. The upper pair of left panel buckle clips 222 and the lower pair of left panel buckle clips 224 on a first barrier section 202 may detachably couple to the upper pair of right panel buckle clips 242 and the lower pair of right panel buckle clips 244 on a second barrier section 204 such that the first barrier section 202 may be detachably coupled to the second barrier section 204 to lengthen the visual barrier.

The individual barrier panel selected from the left barrier panel 220, the center barrier panel 230, and the right barrier panel 240 may comprise a wire frame 232, a fabric center 234, and a guyline loop 236. The fabric center 234 may be coupled to the wire frame 232. The wire frame 232 may support the fabric center 234 when the visual barrier is erected. The fabric center may be a piece of flexible and opaque material that may be stretched by the wire frame 232. As a non-limiting example, the fabric center 234 may be made of a lightweight material such as nylon to enhance the portability of the individual barrier section 210.

The guyline loop 236 may be a loop of material coupled to the top center of the individual barrier panel. The guyline loop 236 may be operable to secure an individual guyline 272 to the individual barrier panel in order to support the top of the individual barrier panel.

An individual apron may be operable to anchor the bottom of the individual barrier panel when the visual barrier is erected. The individual apron selected from the left apron 212 and the right apron 214 may comprise a front apron half 250 and a rear apron half 252. The front apron half 250 may be coupled to the bottom front of the individual barrier panel and the rear apron half 252 may be coupled to the bottom rear of the individual barrier panel. Both the front apron half 250 and the rear apron half 252 may hang down below the bottom of the individual barrier panel. The front apron half 250 may be pulled to the front of the individual barrier panel and the rear apron half 252 may be pulled to the rear of the individual barrier panel.

An individual apron half selected from the front apron half 250 and the rear apron half 252 may comprise a plurality of stake apertures 254. The individual apron may anchor the bottom of the individual barrier panel by driving the plurality of stakes 270 through the plurality of stake apertures 254. Alternatively, the individual apron may anchor the individual barrier panel by placing one or more objects on the front apron half 250 and/or the rear apron half 252. As a non-limiting example, the one or more objects may comprise a medical bag 910, tool box, and/or other equipment from the emergency vehicle 900.

An individual pair of buckle clips selected from the upper pair of left panel buckle clips 222, the lower pair of left panel buckle clips 224, the upper pair of right panel buckle clips 242, and the lower pair of right panel buckle clips 244 may comprise a male buckle half 262 and a female buckle half 264 coupled to the individual barrier panel separately and used independently. By presenting both the male buckle half 262 and the female buckle half 264, the individual pair of buckle clips on the first barrier section 202 may couple to the individual pair of buckle clips on the second barrier section 204 without the possibility that the second barrier section 204 may require rotation by 1180 degrees because of a gender mismatch between the individual pairs of buckle clips.

The plurality of guylines may be operable to support the tops of the plurality of barrier panels. The center of the 8 individual guyline 272 selected from the plurality of guylines may be coupled to the guyline loop 236 at the top center of the individual barrier panel. The ends of the individual guyline 272 may be pulled to ground level in front of the individual barrier panel and behind the individual barrier panel and both ends may be secured using individual stakes 274 or by some other means. The individual guyline 272 may prevent the individual barrier panel from leaning forward or rearward.

In some embodiments, the invention 100 may further comprise a storage bag 280 that the individual barrier section 210 may be stored within when the individual barrier section 210 is collapsed.

To collapse the individual barrier section 210, the left barrier panel 220 and the right barrier panel 240 may first be folded back 180 degrees to positions that place the left barrier panel 220 and the right barrier panel 240 adjacent to the center barrier panel 230 on opposites sides of the center barrier panel 230. The wire frames 232 of the left barrier panel 220, the center barrier panel 230, and the right barrier panel 240 May then be treated as a single wire frame. The single wire frame may be adapted to be grasped by both hands and twisted to fold the single wire frame into a smaller size. The individual barrier section 210, thus folded, may be placed into the storage bag 280. To deploy the individual barrier section 210, the individual barrier section 210 may be removed from the storage bag 280, untwisted to restore the single wire frame to full size, and unfolded to reveal the left barrier panel 220, the center barrier panel 230, and the right barrier panel 240.

In use, the individual barrier section 210 may be removed from the storage bag 280 and expanded to the unfolded state by a user. As a non-limiting example, the user may be a first responder 952. The individual barrier section 210 may be positioned to block sight lines between the accident victim 920 and motorists. The bottom of the individual barrier section 210 may be secured using the plurality of aprons. Specifically, the plurality of aprons may be staked, weights may be placed upon the plurality of aprons, or both. The top of the individual barrier section 210 may be secured using the plurality of guylines. Specifically, the individual guylines 272 may be coupled to the guyline loops 236 located at the top of the individual barrier sections 210 and the ends of the individual guylines 272 may be staked.

A first barrier section 202 may be detachably coupled to a second barrier section 204 to lengthen the visual barrier by coupling the upper pair of left panel buckle clips 222 on the first barrier section 202 to the upper pair of right panel buckle clips 242 on the second barrier section 204 and by coupling the lower pair of left panel buckle clips 224 on the first barrier section 202 to the lower pair of right panel 14 buckle clips 244 on the second barrier section 204. At each coupling of the upper pair of left panel buckle clips 222 to the upper pair of right panel buckle clips 242 or the lower pair of left panel buckle clips 224 to the lower pair of right panel buckle clips 244, the male buckle half 262 on the first barrier section 202 may be coupled to the female buckle half 264 on the second barrier section 204 or the female buckle half 264 on the first barrier section 202 may be coupled to the male buckle half on the second barrier section 204 with regard for the orientation of the first barrier section 202 relative to the second barrier section 204.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, an "anchor" may be a device that holds an object in place. When used as a verb, "anchor" may refer to holding an object firmly or securely.

As used in this disclosure, an "aperture" may be an opening in a surface or object. Aperture may be synonymous with hole, slit, crack, gap, slot, or opening.

As used in this disclosure, the word "buckle" may refer to any fastener that is used for joining a first loose end of a strap to a second loose end of the same strap or to a loose end of a different strap.

As used herein, the words "couple", "couples", "coupled" or "coupling", may refer to connecting, either directly or indirectly, and does not necessarily imply a mechanical connection.

As used herein, "deploy" may refer to configuring a device to place the device into service or to make the device ready for service. As non-limiting examples, "deployed" may be synonymous with extended, unfolded, inflated, erected, or activated. As non-limiting examples, a device that is not deployed may be referred to as retracted, folded, deflated, withdrawn, collapsed, stowed, or deactivated.

As used in this disclosure, "flexible" may refer to an object or material which will deform when a force is applied to it, which will not return to its original shape when the deforming force is removed, and which may not retain the deformed shape caused by the deforming force.

As used herein, "front" may indicate the side of an object that is closest to a forward direction of travel under normal use of the object or the side or part of an object that normally presents itself to view or that is normally used first. "Rear" or "back" may refer to the side that is opposite the front.

Unless noted otherwise, "ground" may refer to any surface which may support items and individuals. As non-limiting examples, ground may refer to an earthen surface whether covered by vegetation or not, a floor, a tarmac, a driveway, a road, a deck, bedrock, or a stage. The phrase "from the ground" may refer to performing an activity while standing on such a surface as opposed to climbing a ladder.

As used in this disclosure, "orientation" may refer to the positioning and/or angular alignment of a first object relative to a second object or relative to a reference position or reference direction.

As used herein, "rectangle" and "rectangular" may refer to a closed figure comprising four straight lines joined by four right angles. The opposing sides of a rectangle have equal length. A square is considered to be a special type of rectangle where all four sides are the same length. An object may still be considered to have a generally rectangular shape even if corners of the object are rounded off as long as two sets of opposing, straight-line, perpendicular sides are apparent.

As used herein, "sightline" may refer to an imaginary line between an observer's eye(s) and a subject of interest. A sightline may also be referred to as a "line of sight". As used in this disclosure, a "stake" may be a shaft that is driven into a horizontal surface, such as the ground, to serve as an anchor point.

As used in this disclosure, "vertical" may refer to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 9, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A portable privacy screen comprising:

one or more barrier sections, a plurality of guylines, and a plurality of stakes;

wherein the portable privacy screen is a visual barrier that is adapted to be erected at an accident scene to provide privacy for an accident victim;

wherein an individual barrier section selected from the one or more barrier sections is collapsible for storage within an emergency vehicle;

wherein a selected individual barrier section is coupled end-to-end to another selected individual barrier section in order to lengthen the visual barrier;

wherein the individual barrier section comprises a plurality of barrier panels a plurality of aprons;

wherein an individual barrier panel selected from the plurality of barrier panels is an opaque rectangular panel erected in a vertical orientation to block a sight line;

wherein the plurality of aprons are flexible extensions coupled to the bottom of one or more of the plurality of barrier panels that are operable to retain the bottom of the individual barrier panel in place;

wherein the plurality of barrier panels are hingedly coupled such that a left barrier panel and a right barrier panel fold back by 180 degrees to a position that is adjacent to the center barrier panel;

wherein the individual barrier panel selected from the left barrier panel, a center barrier panel, and the right barrier panel comprises a wire frame, a fabric center, and a guyline loop;

wherein the guyline loop is operable to secure an individual guyline to the individual barrier panel in order to support the top of the individual barrier panel.

2. The portable privacy screen according to claim 1 wherein the individual barrier section is secured in place by the plurality of aprons located at the bottom of the individual barrier section, by the plurality of guylines, by the plurality of stakes, or by any combination thereof.

3. The portable privacy screen according to claim 2 wherein the individual barrier section comprises three barrier panels and two aprons; wherein the three barrier panels comprises the left barrier panel, the center barrier panel, and the right barrier panel; wherein the two aprons comprises a left apron that is coupled to the bottom of the left barrier panel and a right apron that is coupled to the bottom of the right barrier panel.

4. The portable privacy screen according to claim 3 wherein the left barrier panel comprises an upper pair of left panel buckle clips and a lower pair of left panel buckle clips;

wherein the right barrier panel comprises an upper pair of right panel buckle clips and a lower pair of right panel buckle clips;

wherein the upper pair of left panel buckle clips and the lower pair of left panel buckle clips on a first barrier section detachably couple to the upper pair of right panel buckle clips and the lower pair of right panel buckle clips on a second barrier section such that the first barrier section detachably couples to the second barrier section to lengthen the visual barrier.

5. The portable privacy screen according to claim 4 wherein the fabric center is coupled to the wire frame;

wherein the wire frame supports the fabric center.

6. The portable privacy screen according to claim 5 wherein the fabric center is a piece of flexible and opaque material that is stretched by the wire frame.

7. The portable privacy screen according to claim 6 wherein the fabric center is made of nylon.

8. The portable privacy screen according to claim 6 wherein the guyline loop is a loop of material coupled to the top center of the individual barrier panel.

9. The portable privacy screen according to claim 8 wherein an individual apron is operable to anchor the bottom of the individual barrier panel when the visual barrier is erected;

wherein the individual apron selected from the left apron and the right apron comprises a front apron half and a rear apron half;

wherein the front apron half is coupled to the bottom front of the individual barrier panel and the rear apron half is coupled to the bottom rear of the individual barrier panel;

wherein both the front apron half and the rear apron half hang down below the bottom of the individual barrier panel;

wherein the front apron half is pulled to the front of the individual barrier panel and the rear apron half is pulled to the rear of the individual barrier panel.

10. The portable privacy screen according to claim 9 wherein an individual apron half selected from the front apron half and the rear apron half comprises a plurality of stake apertures;

wherein the individual apron anchors the bottom of the individual barrier panel by driving the plurality of stakes through the plurality of stake apertures.

11. The portable privacy screen according to claim 9 wherein the individual apron anchors the individual barrier panel by placing one or more objects on the front apron half and/or the rear apron half.

12. The portable privacy screen according to claim 9 wherein an individual pair of buckle clips selected from the upper pair of left panel buckle clips, the lower pair of left panel buckle clips, the upper pair of right panel buckle clips, and the lower pair of right panel buckle clips comprises a male buckle half and a female buckle half coupled to the individual barrier panel separately and usable independently.

13. The portable privacy screen according to claim 12 wherein the plurality of guylines are operable to support the tops of the plurality of barrier panels;

wherein the center of the individual guyline selected from the plurality of guylines is coupled to the guyline loop at the top center of the individual barrier panel.

14. The portable privacy screen according to claim 13 wherein the ends of the individual guyline are pulled to ground level in front of the individual barrier panel and behind the individual barrier panel and both ends are secured using individual stakes;

wherein the individual guyline prevents the individual barrier panel from leaning forward or rearward.

15. The portable privacy screen according to claim 14 wherein the portable privacy screen further comprises a storage bag that the individual barrier section is stored within when the individual barrier section is collapsed.

16. The portable privacy screen according to claim 15 wherein to collapse the individual barrier section, the left barrier panel and the right barrier panel are first folded back 180 degrees to positions that place the left barrier panel and the right barrier panel adjacent to the center barrier panel on opposites sides of the center barrier panel;

wherein the wire frames of the left barrier panel, the center barrier panel, and the right barrier panel are then treated as a single wire frame;

wherein the single wire frame is adapted to be grasped by both hands and twisted to fold the single wire frame into a smaller size;

wherein the individual barrier section, thus folded, is placed into the storage bag;

wherein to deploy the individual barrier section, the individual barrier section is removed from the storage bag, untwisted to restore the single wire frame to full size, and unfolded to reveal the left barrier panel, the center barrier panel, and the right barrier panel.

17. A portable privacy screen comprising:

one or more barrier sections;

wherein the portable privacy screen is a visual barrier that is adapted to be erected at an accident scene to provide privacy for an accident victim;

wherein an individual barrier section selected from the one or more barrier sections is collapsible for storage within an emergency vehicle;

wherein a selected individual barrier section is coupled end-to-end to another selected individual barrier section in order to lengthen the visual barrier;

a plurality of guylines, and a plurality of stakes;

wherein the individual barrier section is secured in place by a plurality of aprons located at the bottom of the individual barrier section, by the plurality of guylines, by the plurality of stakes, or by any combination thereof;

wherein the individual barrier section comprises a plurality of barrier panels and the plurality of aprons;

wherein an individual barrier panel selected from the plurality of barrier panels is an opaque rectangular panel erected in a vertical orientation to block a sight line;

wherein the plurality of aprons are flexible extensions coupled to the bottom of one or more of the plurality of barrier panels that are operable to retain the bottom of the individual barrier panel in place;

wherein the plurality of barrier panels are hingedly coupled such that the left barrier panel and the right barrier panel fold back by 180 degrees to a position that is adjacent to the center barrier panel.

* * * * *